United States Patent [19]

Agrawal

[11] Patent Number: 4,927,441

[45] Date of Patent: May 22, 1990

[54] HIGH PRESSURE NITROGEN PRODUCTION CRYOGENIC PROCESS

[75] Inventor: Rakesh Agrawal, Allentown, Pa.

[73] Assignee: Air Products and Chemicals, Inc., Allentown, Pa.

[21] Appl. No.: 428,377

[22] Filed: Oct. 27, 1989

[51] Int. Cl.[5] ..... F25J 3/02

[52] U.S. Cl. ..... 62/28; 62/39; 62/44

[58] Field of Search ..... 62/11, 13, 24, 28, 39, 62/44

[56] References Cited

U.S. PATENT DOCUMENTS

| | | | |
|---|---|---|---|
| 4,222,756 | 9/1980 | Thorogood | 62/13 |
| 4,617,036 | 10/1986 | Suchdeo et al. | 62/11 |
| 4,662,916 | 5/1987 | Agrawal et al. | 62/39 |
| 4,662,917 | 5/1987 | Comier, Sr. et al. | 62/39 |
| 4,662,918 | 5/1987 | Agrawal et al. | 62/13 |
| 4,707,994 | 11/1987 | Shenoy et al. | 62/11 |
| 4,783,210 | 11/1988 | Ayres et al. | 62/39 |
| 4,848,996 | 7/1989 | Thorogood et al. | 62/39 |
| 4,872,893 | 10/1989 | Agrawal | 62/11 |

*Primary Examiner*—Ronald C. Capossela

*Attorney, Agent, or Firm*—Willard Jones, II; James C. Simmons; William F. Marsh

[57] ABSTRACT

The present invention is a cryogenic process to produce medium to high pressure gaseous nitrogen without the use of a nitrogen product compressor. The process is an improvement to a conventional nitrogen generator with waste expander. The present invention reboils crude liquid oxygen from the main distillation column in two stages at different pressures and uses a small number of trays above one of the reboilers. The use of the trays above one of the reboilers allows collection of a pressurized stream with a composition similar to air. This pressurized stream is recycled to an intermediate stage of the main air compressor.

6 Claims, 3 Drawing Sheets

HIGH PRESSURE NITROGEN PRODUCTION CRYOGENIC PROCESS

TECHNICAL FIELD

The present invention is related to a process for the cryogenic distillation of air or oxygen/nitrogen mixtures to produce a nitrogen product stream.

BACKGROUND OF THE INVENTION

Numerous processes are known in the art for the production of a nitrogen product stream by using cryogenic distillation. The conventional process for the production of pressurized nitrogen directly from a cryogenic separation zone uses a single pressure distillation column with the oxygen rich waste stream being used at least in part to provide the process refrigeration by work expansion. Details of such processes are disclosed in U.S. Pat. No. 4,222,756.

U.S. Pat. No. 4,848,996 discloses an improvement to a standard nitrogen generator. The improvement is two-fold; first, the addition of one or more distillation stages above the reboiler, which stages effectively transform the reboiler/condenser into a partial low pressure column and allow further separation (rectification) of the nitrogen generator bottoms liquid into two streams. Second, the recycle of the overhead stream (at a composition close to that of air) from the top of the low pressure column to the main air compressor. Additionally, at least a portion of the oxygen-enriched stream that exits the low pressure column below the bottom tray is expanded to provide refrigeration for the cycle.

U.S. Pat. No. 4,872,893 discloses a process for the recovery of nitrogen from a feed gas stream, containing nitrogen and oxygen, using a cryogenic separtion wherein a recycle stream having an oxygen content above that of the feed gas is recycled from the cryogenic separation to the feed gas stream without any intervening process step that would decrease the oxygen content of the recycle stream.

U.S. Pat. No. 4,872,893 discloses a process for the recovery of nitrogen from a feed gas stream, containing nitrogen and oxygen, using a cryogenic distillation wherein a recycle stream having an oxygen content above, equal to or below that of the feed gas stream is recycled from the cryogenic separation to the feed gas stream with a split reboiler/condenser function that would allow variation of the oxygen content of the recycle stream.

SUMMARY OF THE INVENTION

The present invention is an improvement to a process for the separation of a feed stream, comprising air or gas mixtures containing oxygen and nitrogen, by cryogenic distillation. In the process, the feed stream is compressed by a multi-staged main compressor, cooled to near the dew point of the feed stream and separated into a nitrogen overhead and an oxygen-enriched bottoms liquid in a rectifier; at least a portion of the nitrogen overhead is condensed to provide reflux for the rectifier; at least another portion of the nitrogen overhead is removed from the process as gaseous nitrogen product., the oxygen-enriched bottoms liquid is stripped in a distillation zone comprising one or more distillation stages into a synthetic air stream and a second oxygen-enriched liquid; and the synthetic air stream is warmed to recover refrigeration and subsequently recycled to the process. In recycling, the synthetic air stream is fed to an intermediate location of the multi-stage main compressor or compressed in a recycle compressor and combined with the feed air stream prior to cooling.

The improvement for producing medium to high pressure gaseous nitrogen product in a more energy efficient manner comprises the following steps: (1) the portion of the nitrogen overhead to be condensed to provide reflux for the rectifier is divided into two substreams, a first nitrogen overhead substream and a second nitrogen overhead substream; (2) the first nitrogen overhead substream is condensed by indirect heat exchange with the second oxygen-enriched liquid thereby producing a first liquid nitrogen stream; (3) at least a portion of the second oxygen-enriched liquid is reduced in pressure to produce a reduced pressure oxygen-enriched liquid stream; (4) the second nitrogen overhead substream is condensed by indirect heat exchange with the reduced pressure oxygen-enriched liquid stream thereby producing a second liquid nitrogen stream and a gaseous, oxygen-enriched waste stream; (5) the first and second liquid nitrogen streams are fed to the top of the rectifier to provide reflux; and (6) at least a portion of the gaseous, oxygen-enriched waste stream is expanded and subsequently warmed to recover refrigeration for the process.

DETAILED DESCRIPTION OF THE INVENTION

The present invention is a modified standard plant cycle with one or more trays added above the reboiler and two stages of condensation to produce reflux for the main distillation column that produces gaseous nitrogen (GAN) at medium to high pressure without the need for a nitrogen product compressor. The feed to the process, although typically being air, can be any gaseous mixture comprising oxygen and nitrogen. The process of the present invention and its benefits are best understood in relation to the prior art processes, which are shown in FIGS. 1 and 2.

Figure 1:
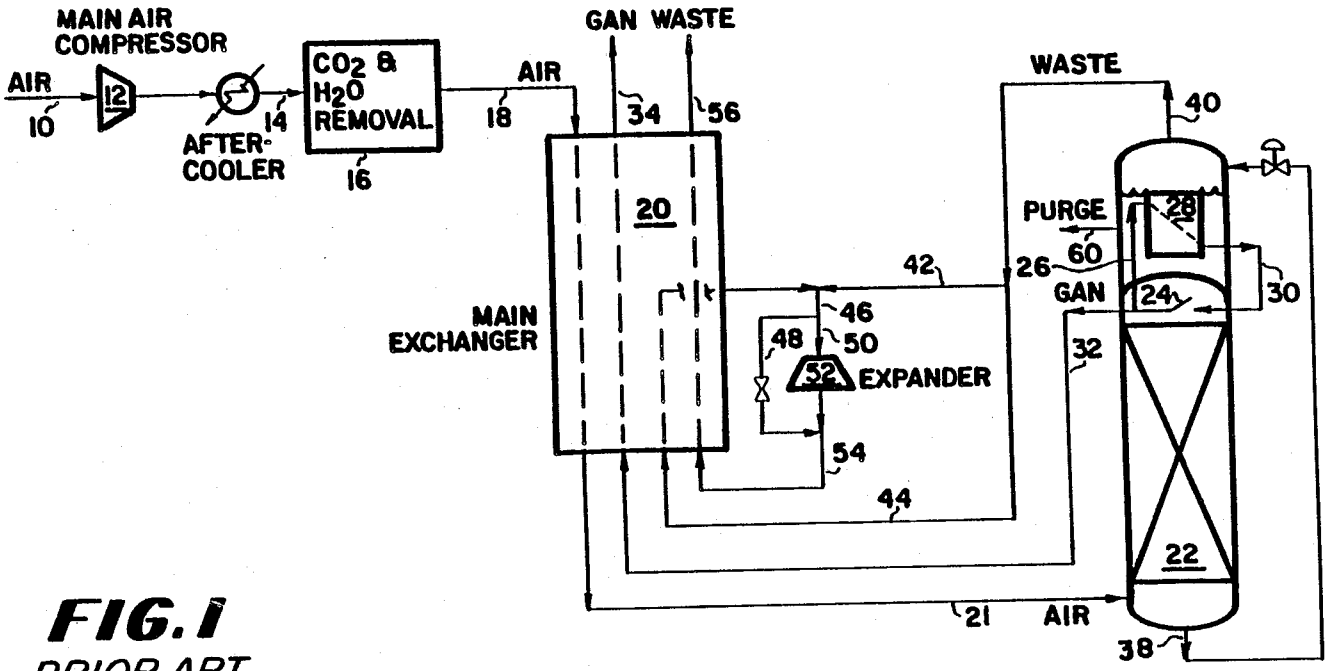
FIG. 1 PRIOR ART
FIG. 1 is a schematic diagram of a conventional nitrogen generator.
Figure 2:
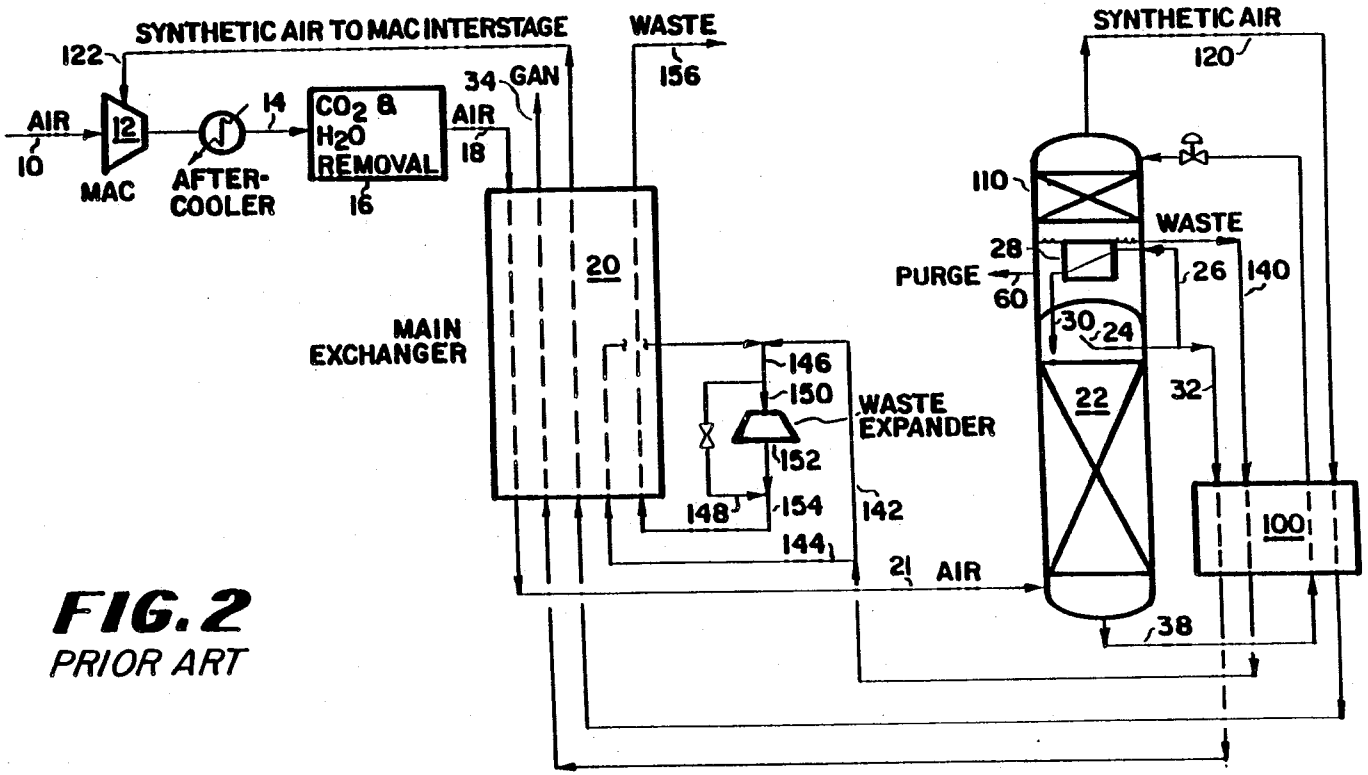
FIG. 2 PRIOR ART
FIG. 2 is a schematic diagram of the process disclosed in U.S. Pat. No. 4,848,996.

With reference to FIG. 1, a feed air stream is fed to main air compressor (MAC) 12 via line 10. After compression the feed air stream is aftercooled usually with either an air cooler or a water cooler, and then processed in unit 16 to remove any contaminants which would freeze at cryogenic temperatures, i.e., water and carbon dioxide. The processing to remove the water and carbon dioxide can be any known process such as an adsorption mole sieve bed. This compressed, water and carbon dioxide free, air is then fed to main heat exchanger 20 via line 18, wherein it is cooled to near its dew point. The cooled feed air stream is then fed to the bottom of rectifier 22 via line 21 for separation of the feed air into a nitrogen overhead stream and an oxygen-enriched bottoms liquid.

The nitrogen overhead is removed from the top of rectifier 22 via line 24 and is then split into two substreams. The first substream is fed via line 26 to reboiler/condenser 28 wherein it is liquefied and then returned to the top of rectifier 22 via line 30 to provide reflux for the rectifier. The second substream is removed from rectifier 22 via line 32, warmed in main heat exchanger 20 to provide refrigeration and removed from the process as a gaseous nitrogen product stream via line 34.

An oxygen-enriched bottoms liquid is removed from the bottom of rectifier 22 via line 3B, reduced in pressure and fed to the sump surrounding reboiler/condenser 28 wherein it is vaporized thereby condensing the nitrogen overhead in line 26. The vaporized oxygen-enriched or waste stream is removed from the overhead of the sump area surrounding reboiler/condenser 28 via line 40.

This vaporized waste stream is then processed to recover refrigeration which is inherent in the stream. In order to balance the refrigeration provided to the process from the refrigeration inherent in the waste stream, stream 40 is split into two portions. The first portion is fed to main heat exchanger 20 via line 44 wherein it is warmed to recover refrigeration. The second portion is combined via line 42 with the warmed first portion in line 44 to form line 46. This recombined stream in line 46 is then split into two parts, again to balance the refrigeration requirements of the process. The first part in line 50 is expanded in expander 52 and then recombined with the second portion in line 48, after it has been let down in pressure across a valve, to form an expanded waste stream in line 54. This expanded waste stream is then fed to and warmed in main heat exchanger 20 to provide refrigeration and is then removed from the process as waste via line 56.

Finally, a small purge stream is removed via line 60 from the sump surrounding reboiler/condenser 28 to prevent the build up of hydrocarbons in the liquid in the sump. If needed, a liquid nitrogen product is also recoverable as a fraction of the condensed nitrogen stream.

U.S. Pat. No. 4,848,996 disclosed an improvement to the process shown in FIG. 1; the improved process is shown in FIG. 2. Similar process streams shown in FIGS. 1 and 2 are numbered with the same numbers. Turning now to FIG. 2, the improvement is the addition of one or more distillation stages, area 110, to the area above reboiler/condenser 28, which effectively transforms the reboiler/condenser section into a partial low pressure (LP) column and allows further separation (stripping) of the high pressure (HP) column bottom stream in line 38 into two streams: an oxygen-enriched waste stream in line 140 and a synthetic air stream having a composition near that of air in line 120. The distillation stages may be of any type, e.g. trays or structured packing.

The oxygen-enriched waste stream exits the LP column below the bottom tray via line 140 and is expanded to provide refrigeration for the cycle, this expansion process is identical to that described for stream 40 in FIG. 1.

The synthetic air stream is removed from the overhead via line 120 at a composition close to that of air, warmed in heat exchangers 100 and 20 to recover refrigeration and then recycled at pressure to main air compressor 12 at an interstage location. This recycle reduces the feed air flow in line 10 to main air compressor 12 thus resulting in a reduction in compressor power.

It is important to note that no product nitrogen is produced from the lower pressure column as occurs in conventional double column processes.

Figure 3:
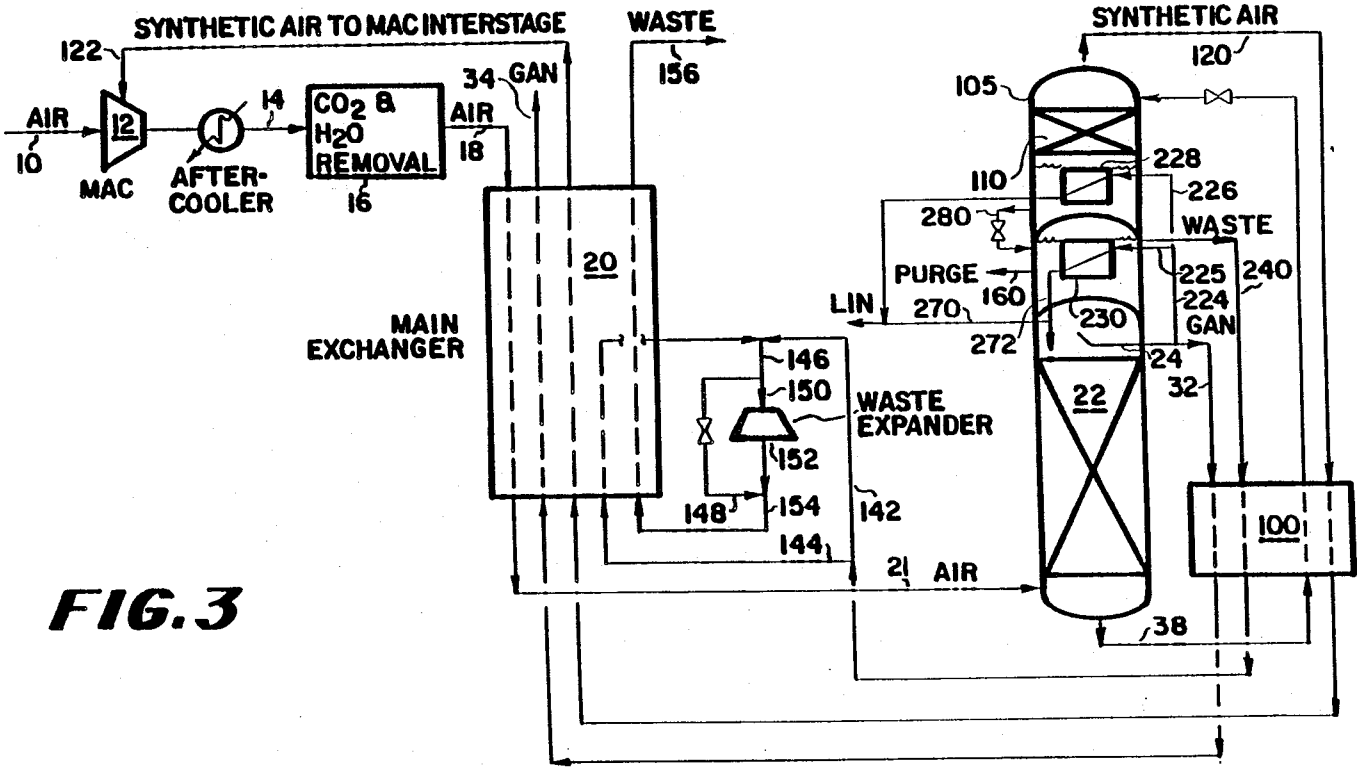
FIG. 3 is a schematic diagram of the process of the present invention.

The present invention, which is further improvement to the processes of FIGS. 1 and 2 (particularly, FIG. 2). is shown in FIG. 3. In FIG. 3, similar process streams as in FIGS. 1 and 2 are numbered with the same numbers. With reference to FIG. 3, an oxygen-enriched bottoms liquid is removed from the bottom of HP column 22, reduced in pressure and fed to the top of LP column 105 for separation (stripping) in tray or packing section 110 into a synthetic air stream and a second oxygen-enriched liquid. A portion of the second oxygen-enriched liquid is vaporized by indirect heat exchange with a portion of the condensing nitrogen overhead. At least a further portion of the second oxygen-enriched bottoms liquid is removed from the bottom of LP column 105 from the liquid sump surrounding reboiler/condenser 228 and is reduced in pressure and fed to the sump surrounding reboiler/condenser 230 wherein it is vaporized forming a gaseous oxygen-enriched waste stream. The oxygen-enriched waste stream is then removed from the overhead area of the sump surrounding reboiler/condenser 230 via line 240. This oxygen-enriched waste stream, in line 240, is expanded to provide refrigeration for the cycle, this expansion process is identical to that described for stream 40 in FIG. 1.

The synthetic air stream is removed from the overhead of LP column 105 via line 120 at a composition close to that of air, warmed in main heat exchanger 20 to provide refrigeration and recycled at pressure to main air compressor 12 at an interstage location. This recycle reduces the feed air flow in line 10 to main air compressor 12 thus resulting in a reduction in compressor power. If the pressure of the recycle synthetic air does not match the pressure of an interstage suction pressure of the main air compressor then its pressure can be let down across a valve to match such pressure with an interstage suction pressure. Alternatively, a separate compressor could be used to compress recycle stream 122 and the compressed stream can be mixed with the feed air stream in line 18.

Nitrogen overhead is removed, via line 24, from HP column 22. This nitrogen stream is divided into two portions, a first portion, in line 224, which is ultimately condensed to provide reflux to the rectifier or HP column, and a second portion which is removed, via line 32, as medium to high pressure nitrogen product; the processing of stream 32 is identical to that shown in FIG. 2. The first portion, in line 224, which is ultimately condensed to provide reflux is divided into two substreams, substreams 225 and 226. The substream in line 225 is fed to reboiler/condenser 230, condensed therein by indirect heat exchange with the reduced pressure oxygen-enriched liquid and returned to distillation column 22, via line 272, to provide reflux to HP column 22. The substream in line 226 is fed to reboiler/condenser 228, condensed therein by indirect heat exchange with the second oxygen-enriched liquid and returned to distillation column 22, via line 270 to provide further reflux to the (HP) column. If needed, a small fraction of the reflux streams can be recovered as liquid nitrogen product.

Finally, a small purge stream is removed via line 160 from the sump surrounding reboiler/condenser 230 to prevent the build up of hydrocarbons in the liquid in the sump.

In order to demonstrate the efficacy of the present invention, several computer simulations where made of the process of the present invention. Cycle calculations were based on a GAN production at 115 PSIA with no liquid nitrogen (LIN) production and were made using between one and four distillation trays in the LP column. Table I lists the process specifications and Table II lists the results and a comparison with the standard plant cycle depicted in FIG. 1 and the process of U.S. Pat. No. 4,848,996 depicted in FIG. 2, both operating at 115 psia. Note that for all the cycles, some expander bypass exists which could be translated into LIN make.

TABLE I

PROCESS SPECIFICATIONS FOR COMPUTER SIMULATIONS

| | |
|---|---|
| Distillation Section: | |
| HP Column Tray Count: | 50 |
| LP Column Tray Count: | see Table II |
| Heat Exchanger Sections: | |
| Main Exchanger NTU Count: | 60–70 |
| Overhead Reboiler/Condenser ΔT: | 4.35° F. |
| Compressor/Expander Sections: | |
| Air Feed: | 70° F. and 50% Relative Humidity |
| Isothermal Efficiency: | 70% |
| Motor Efficiency: | 95% |
| Air Compressor Suction Pressure: | 14.5 psia |
| Expander Efficiency: | 85% |
| No power credit for expander | |

which uses a nitrogen product compressor to compress the nitrogen product produced by the optimized conventional process of FIG. 1 (i.e.. operating such that the nitrogen product in line 34 is produced at the lowest possible pressure so that the flow in the expander bypass line 48 is essentially eliminated). For example, if one simulates the optimized conventional process, producing nitrogen product at 66 psia and then compresses that nitrogen product to 115 psia, the specific power requirement to do so is 0.541 KWH/100 SCF. While this specific power requirement is lower than the 0.555 KWH/100 SCF required for the process of FIG. 2, it is about 2.5% higher than the 0.528 KWH/100 SCF required for the process of the present invention.

As can be seen from the above computer simulations, the advantage of the present invention over the prior art processes is that a lower specific power can be achieved while producing GAN directly at medium to high pressures (e.g., 115 psia) without product compression. If nitrogen product is needed at much higher pressures (e.g., 300 psia) such that was closer to its critical pressure and the rectification of air becomes difficult in the HP distillation column, then the product would be produced at the medium to high pressure and subsequently further compressed to a higher pressure with a nitrogen product compressor.

TABLE II

COMPARISON OF THE PROCESS OF THE PRESENT INVENTION WITH A CONVENTIONAL NITROGEN GENERATOR

Basis: Flow from the MAC is fixed at 100 lb mol/hr. The feed air flow to the MAC is varied such that the MAC discharge flow equals 100 lb mol/hr after the addition of the synthetic air recycle flow.

| | | | WASTE | | | SYNTHETIC AIR | | | | |
|---|---|---|---|---|---|---|---|---|---|---|
| LP Col Tray Count | GAN Pressure (psia) | GAN* Recovery % | Pressure at Expan. (psia) | Total Flow (# mol/hr) | $N_2$ (% $N_2$) | Pressure at MAC (psia) | Total FLOW (# mol/hr) | $N_2$ (% $N_2$) | Expander Bypass (# mol/hr) | GAN Spec. Power (kwh/100SCF) |
| Process of FIG. 1 | | | | | | | | | | |
| 0 | 115 | 41.6 | 56.5 | 58.2 | 62.7 | — | — | — | 40 | 0.673 |
| Process of FIG. 2 (U. S. Pat. No. 4,848,996) | | | | | | | | | | |
| 3 | 115 | 62.7 | 44.3 | 25.5 | 42.1 | 43.8 | 31.5 | 81.2 | 6.3 | 0.555 |
| Process of FIG. 3 (Present Invention) | | | | | | | | | | |
| 4 | 115 | 62.7 | 44.3 | 25.5 | 42.1 | 58.8 | 31.5 | 81.1 | 6.3 | 0.528 |

*GAN Recovery (%) = 100 × GAN/(FEED AIR to MAC)

The power calculations in Table II for the main air compressor (MAC) assumed the synthetic air stream to feed between the second and third stages of a four-stage machine.

As Table II shows, the product specific power for the process of the present invention was lower than those for the prior art processes. In fact the process of the present invention had product specific power of 0.528 KWH/100 SCF, while the process disclosed in U.S. Pat. No. 4,848,996 as depicted in FIG. 2 was 0.555 KWH/100 SCF, while the standard plant depicted in FIG. 1 operating at 115 PSIA and without product compression was 0.673 KWH/100 SCF. This constitutes a 4.9% and 21.5% reduction of specific power.

Additionally, the process of the present invention can be compared to the processes taught in U.S. Pat. No. 4,872,893 and U.S.S.N. 07/254,512. These processes have specific powers of 0.621 KWH/100 SCF and 0.609 KWH/100 SCF, respectively. This represents a reduction in specific power of about 15.0% and 13.3%, respectively.

There is another beneficial aspect of the proposed invention. This beneficial aspect can be seen by comparing the process of the present invention with a process The present invention has been described with reference to a specific embodiment thereof. This embodiment should not be viewed as limitations on the present invention, such limitations being ascertained by the following claims.

What is claimed:

1. In a process for the separation of air by cryogenic distillation wherein a feed air stream is compressed by a multi-staged main air compressor, cooled to near the dew point of the feed air stream and separated into a nitrogen overhead stream and an oxygen-enriched bottoms liquid in a rectifier; at least a portion of the nitrogen overhead is condensed to provide reflux for the rectifier; at least another portion of the nitrogen overhead is removed from the process as gaseous nitrogen product; the oxygen-enriched bottoms liquid is stripped in a distillation zone comprising one or more distillation stages into a synthetic air stream and a second oxygen-enriched liquid; and the synthetic air stream is warmed to recover refrigeration and subsequently recycled to the process; the improvement for producing medium to higher pressure gaseous nitrogen product in a more energy efficient manner comprises:

(a) dividing the portion of the nitrogen overhead to be condensed to provide reflux for the rectifier into two substreams, a first nitrogen overhead substream and a second nitrogen overhead substream;

(b) condensing the first nitrogen overhead substream by indirect heat exchange with the second oxygen-enriched liquid thereby producing a first liquid nitrogen stream;

(c) reducing in pressure at least a portion of the second oxygen-enriched liquid to produce a reduced pressure oxygen-enriched liquid stream;

(d) condensing the second nitrogen overhead substream by indirect heat exchange with the reduced pressure oxygen-enriched liquid stream thereby producing a second light nitrogen stream and a gaseous, oxygen-enriched waste stream;

(e) feeding the first and second liquid nitrogen streams to the top of the rectifier to provide reflux; and (f) expanding and subsequently warming at least a portion of the gaseous, oxygen-enriched waste stream to recover refrigeration for the process.

2. The process of claim 1, wherein the distillation zone comprises three or more theoretical stages.

3. The process of claim 1 wherein the synthetic air which is recycled is fed to an intermediate stage of the multi-stage compressor.

4. The process of claim 1 wherein the synthetic air which is recycled is reduced in pressure and fed to an intermediate stage of the multi-stage compressor.

5. The process of claim 1 wherein the synthetic air which is recycled is compressed in a recycle compressor and combined with the compressed feed air prior to cooling.

6. In a process for the separation of a feed gas stream comprising oxygen and nitrogen by cryogenic distillation wherein the feed gas stream is compressed by a multi-staged main compressor, cooled to near the dew point of the feed gas stream and separated into a nitrogen overhead stream and an oxygen-enriched bottoms liquid in a rectifier; at least a portion of the nitrogen overhead is condensed to provide reflux for the rectifier; at least another portion of the nitrogen overhead is removed from the process as gaseous nitrogen product; the oxygen-enriched bottoms liquid is stripped in a distillation zone comprising one or more distillation stages into a recycle stream having a composition similar to the composition of the feed gas stream and a second oxygen-enriched liquid; and the recycle stream is warmed to recover refrigeration and subsequently recycled to the process; the improvement for producing medium to high pressure gaseous nitrogen product in a more energy efficient manner comprises:

(a) dividing the portion of the nitrogen overhead to be condensed to provide reflux for the rectifier into two substreams, a first nitrogen overhead substream and a second nitrogen overhead substream;

(b) condensing the first nitrogen overhead substream by indirect heat exchange with the second oxygen-enriched liquid thereby producing a first liquid nitrogen stream;

(c) reducing in pressure at least a portion of the second oxygen-enriched liquid to produce a reduced pressure oxygen-enriched liquid stream;

(d) condensing the second nitrogen overhead substream by indirect heat exchange with the reduced pressure oxygen-enriched liquid stream thereby producing a second liquid nitrogen stream and a gaseous, oxygen-enriched waste stream;

(e) feeding the first and second liquid nitrogen streams to the top of the rectifier to provide reflux; and (f) expanding and subsequently warming at least a portion of the gaseous, oxygen-enriched waste stream to recover refrigeration for the process.

* * * * *

UNITED STATES PATENT AND TRADEMARK OFFICE

CERTIFICATE OF CORRECTION

PATENT NO. : 4,927,441

DATED : May 22, 1990

INVENTOR(S) : Rakesh Agrawal

It is certified that error appears in the above-identified patent and that said Letters Patent is hereby corrected as shown below:

Column 6, Line 67

Delete "higher" and substitute therefor -- high --

Column 7, Line 15

Delete "light" and substitute therefor -- liquid --

Signed and Sealed this

Twenty-eighth Day of May, 1991

*Attest:*

*Attesting Officer*

HARRY F. MANBECK, JR.

*Commissioner of Patents and Trademarks*